US008123260B2

(12) United States Patent
Marcks et al.

(10) Patent No.: US 8,123,260 B2
(45) Date of Patent: Feb. 28, 2012

(54) LATCHING DEVICE FOR A GRAIN BIN DOOR

(75) Inventors: Randal L. Marcks, Mason City, IA (US); John A. Hanig, Sheffield, IA (US); Charles E. Sukup, Dougherty, IA (US)

(73) Assignee: Sukup Manufacturing Co., Sheffield, IA (US)

( * ) Notice: Subject to any disclaimer, the term of this patent is extended or adjusted under 35 U.S.C. 154(b) by 413 days.

(21) Appl. No.: 12/404,002

(22) Filed: Mar. 13, 2009

(65) Prior Publication Data

US 2010/0230978 A1 Sep. 16, 2010

(51) Int. Cl.
*E05C 9/12* (2006.01)

(52) U.S. Cl. ..... 292/56; 292/259 R; 292/DIG. 30; 292/213; 292/304; 49/463; 49/464; 49/465

(58) Field of Classification Search ..... 292/256, 292/259 R, DIG. 30, 24, 56, 99, 108, 216, 292/194, 241, 304, 92, 465; 49/465; 70/92
See application file for complete search history.

(56) References Cited

U.S. PATENT DOCUMENTS 590,332 A * 9/1897 Palmetier ..... 49/465
1,330,847 A * 2/1920 Crocker ..... 49/465
1,359,702 A * 11/1920 Hockenberry ..... 292/262
1,405,013 A * 1/1922 Schnell ..... 49/466
2,341,763 A * 2/1944 Craine ..... 52/193
2,550,856 A * 5/1951 Ouellet et al. ..... 292/6
3,214,947 A * 11/1965 Wikkerink ..... 70/92
3,266,829 A * 8/1966 Yoe et al. ..... 292/92
3,819,213 A * 6/1974 Vanderburgh ..... 292/21
4,703,961 A * 11/1987 Weinerman et al. ..... 292/216
4,913,478 A 4/1990 Grossman
5,135,271 A 8/1992 Bestwick
5,306,057 A * 4/1994 Miller, Jr. ..... 292/259 R
5,997,099 A * 12/1999 Collins ..... 298/29
6,053,543 A * 4/2000 Arabia et al. ..... 292/201

OTHER PUBLICATIONS

Sukup Manufacturing Company, "Grain Bins for Drying and Storage—The Only Bin Designed for the 21st Century"; USA.

* cited by examiner

*Primary Examiner* — Thomas Beach
*Assistant Examiner* — Sajid R Ansari
(74) *Attorney, Agent, or Firm* — Zarley Law Firm, P.L.C.

(57) ABSTRACT

A latch apparatus for releasably securing a cover member over an access opening in a bulk storage structure. The latch apparatus is pivotally mounted to a cover member and includes a pair of latch members and a latch bar connected to and extending between the latch members. The latch members have a receptacle that receives a catch member and an extension that extends away from the latch member opposite the receptacle. The extension engages the cover member when the latch member is moved from a locked position to an unlocked position to prevent injury to a user.

14 Claims, 6 Drawing Sheets

LATCHING DEVICE FOR A GRAIN BIN DOOR

BACKGROUND OF THE INVENTION

This invention relates to large bulk storage containers. More specifically this invention relates to a latching apparatus for closing and opening a door cover used for closing and opening an access in a bulk storage structure.

Bulk storage structures such as grain bins are well known. Typically a grain bin has an access opening that is enclosed by a cover member. These cover members fit over pins that are attached to a door jamb. Typically, a latching apparatus is used to open and close the cover.

One known latching apparatus is disclosed in U.S. Pat. No. 4,913,478 to Grossman. Grossman teaches a latch bar with a hook means that receives a stud to lock the cover in a closed position. To open the cover the latch bar is lifted to disengage the hook means from the stud. As the latch bar continues to pivot, manual pressure is applied to the cover member to open. As no limitation is placed on the rotation of the latch bar, a user's knuckles can become pinched between the latch bar and the cover causing injury.

Another latching device is disclosed in U.S. Pat. No. 5,135,271 to Bestwick. While similar to Grossman, the Bestwick Patent added a cam surface to assist in opening the cover member. More specifically, as the latch bar was raised the cam surface would engage the catch and provide a mechanical advantage in opening the cover. The Bestwick latch device was more complex and difficult to manufacture.

A third latching device is manufactured by Sukup Manufacturing. The Sukup device has a latching device on each side of the cover that has a handle section, a vertical section, and a locking section that extends outwardly from the vertical portion and is received in a U-shaped or L-shaped channel to lock the cover in a closed position. To open, the handle section is first raised such that the locking section disengages the U-shaped or L-shaped channel. Once disengaged, the device is slid inwardly, away from the U-shaped or L-shaped channel which restricts rotation of the latch. Once the U-shaped or L-shaped channel is cleared, the latch is rotated upwardly until an arcuate portion of the vertical section engages the cover to open the cover. While the arcuate portion assists in preventing injury to a user's knuckles, the operation of the Sukup device is complex requiring multiple movements. Therefore, a need exists in the art for a latching device that addresses these deficiencies.

An object of the present invention is to provide a latching apparatus for a bulk storage structure that reduces injuries.

Another object of the present invention is to provide a latching apparatus for a bulk storage structure that facilitates the opening of a cover on the structure.

Yet another object of the present invention is to provide a latching apparatus that is easier to manufacture and operate.

These and other objects, features and advantages will become apparent from the specification and claims.

BRIEF SUMMARY OF THE INVENTION

A latch apparatus for releasably securing a cover member over an access opening in a bulk storage structure. The latch apparatus having a pair of latch members with an extension that extends away from the receptacle and engages the cover member when the latch member is moved from a locked position to an unlocked position so that the extension prevents further rotation of the latch member.

DETAILED DESCRIPTION OF THE PREFERRED EMBODIMENT OF THE INVENTION

Figure 1:
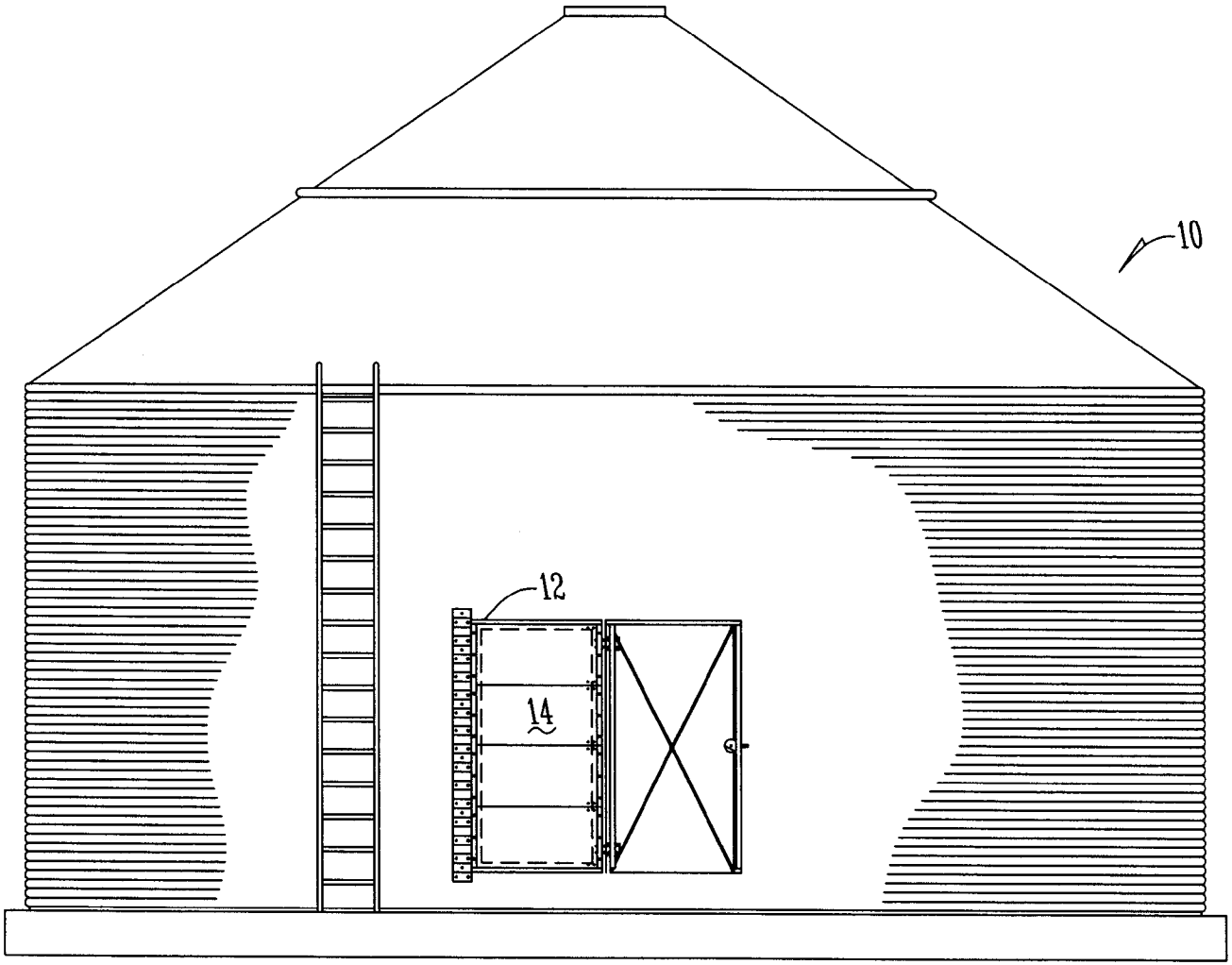
FIG. 1 is a side plan view of a bulk storage structure.

FIG. 1 shows a bulk storage structure 10 that in one embodiment is a grain bin. The bulk storage structure 10 has an access opening 12 that is closed by a cover member 14. As shown in FIGS. 2 through 6, a latch apparatus 16 is used to open and close the cover member 14.

Figure 2:
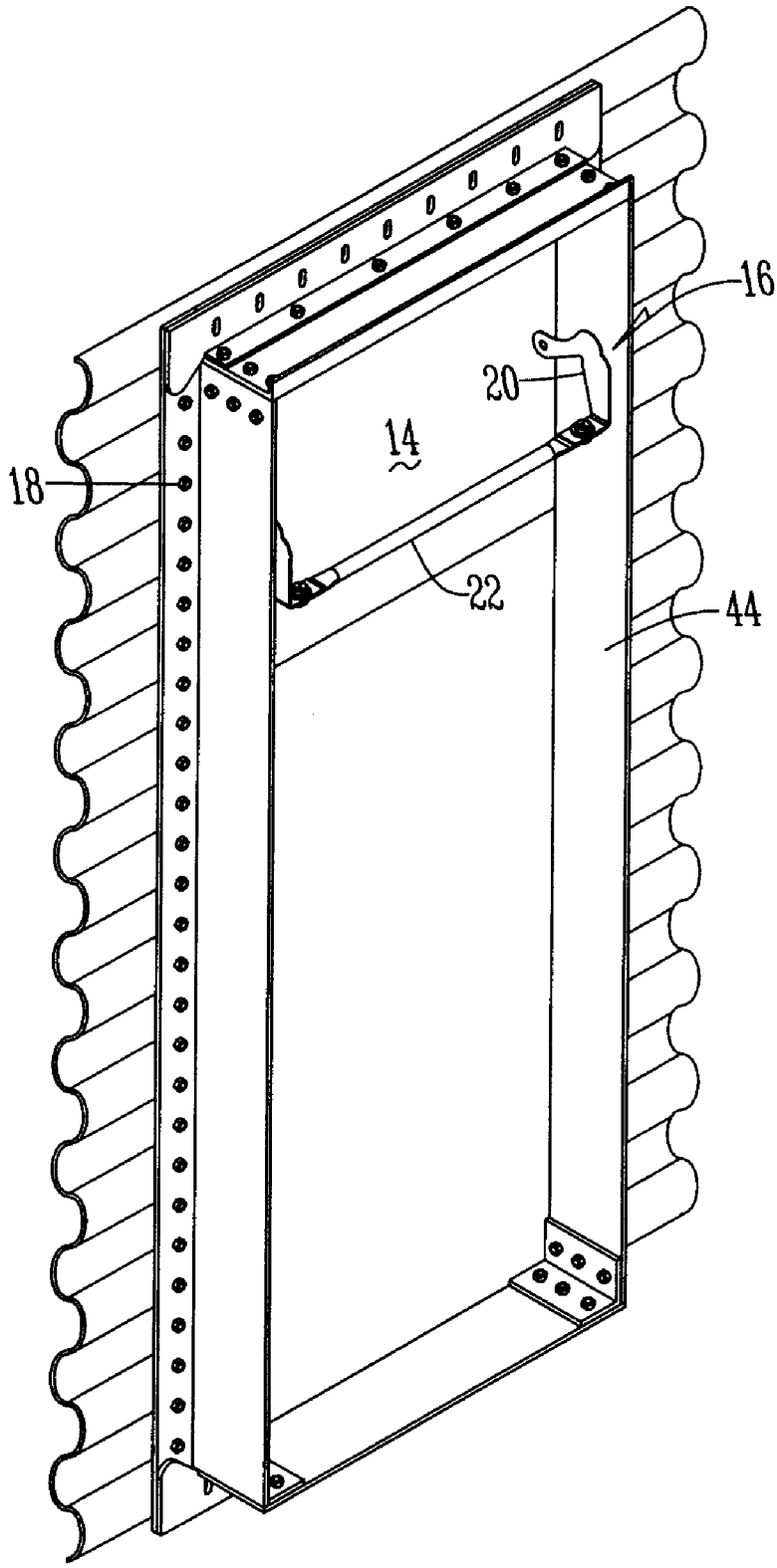
FIG. 2 is a side perspective view of a cover member of a bulk storage structure.
Figure 3:
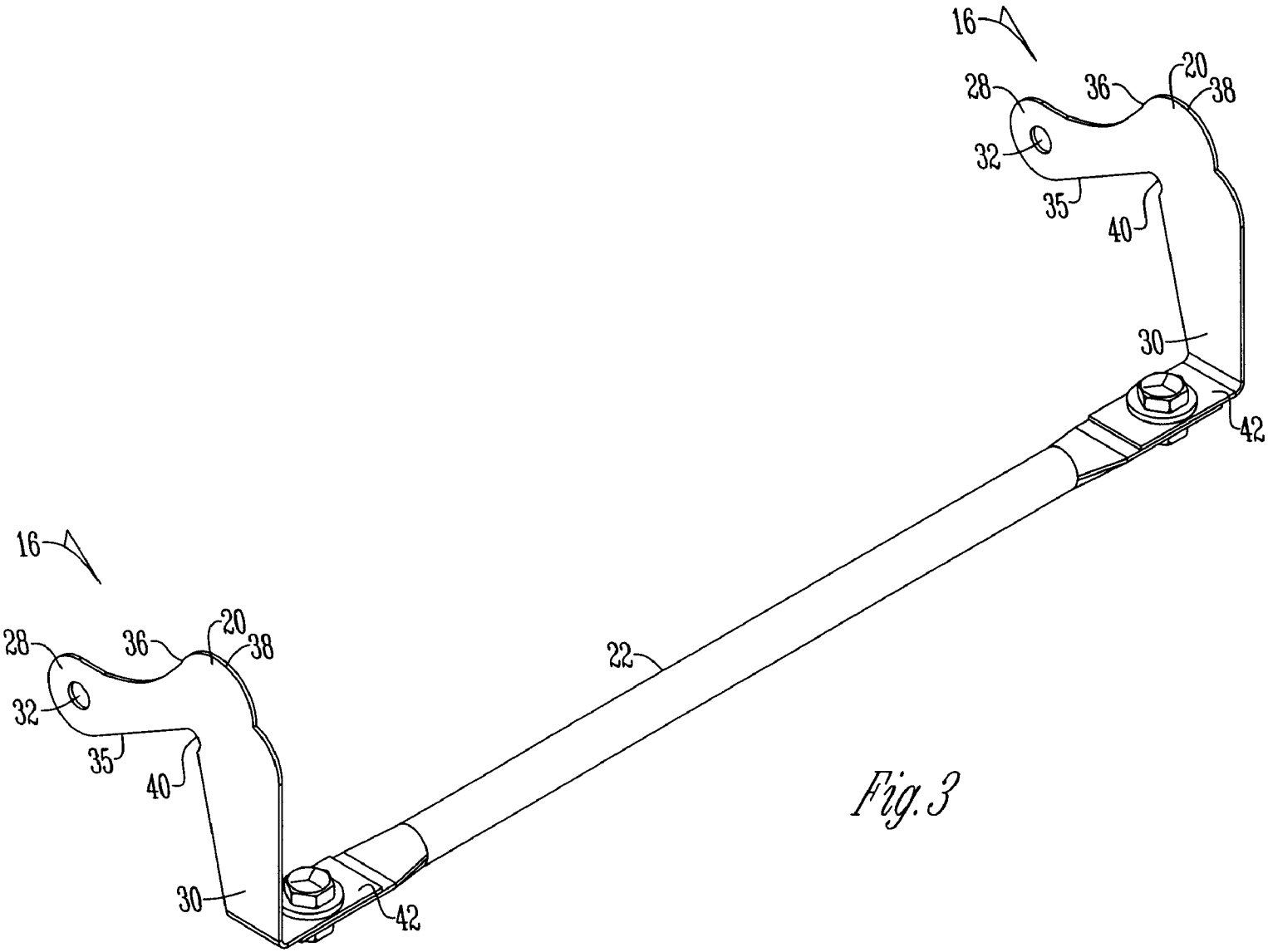
FIG. 3 is a perspective view of a latch member.
Figure 4:
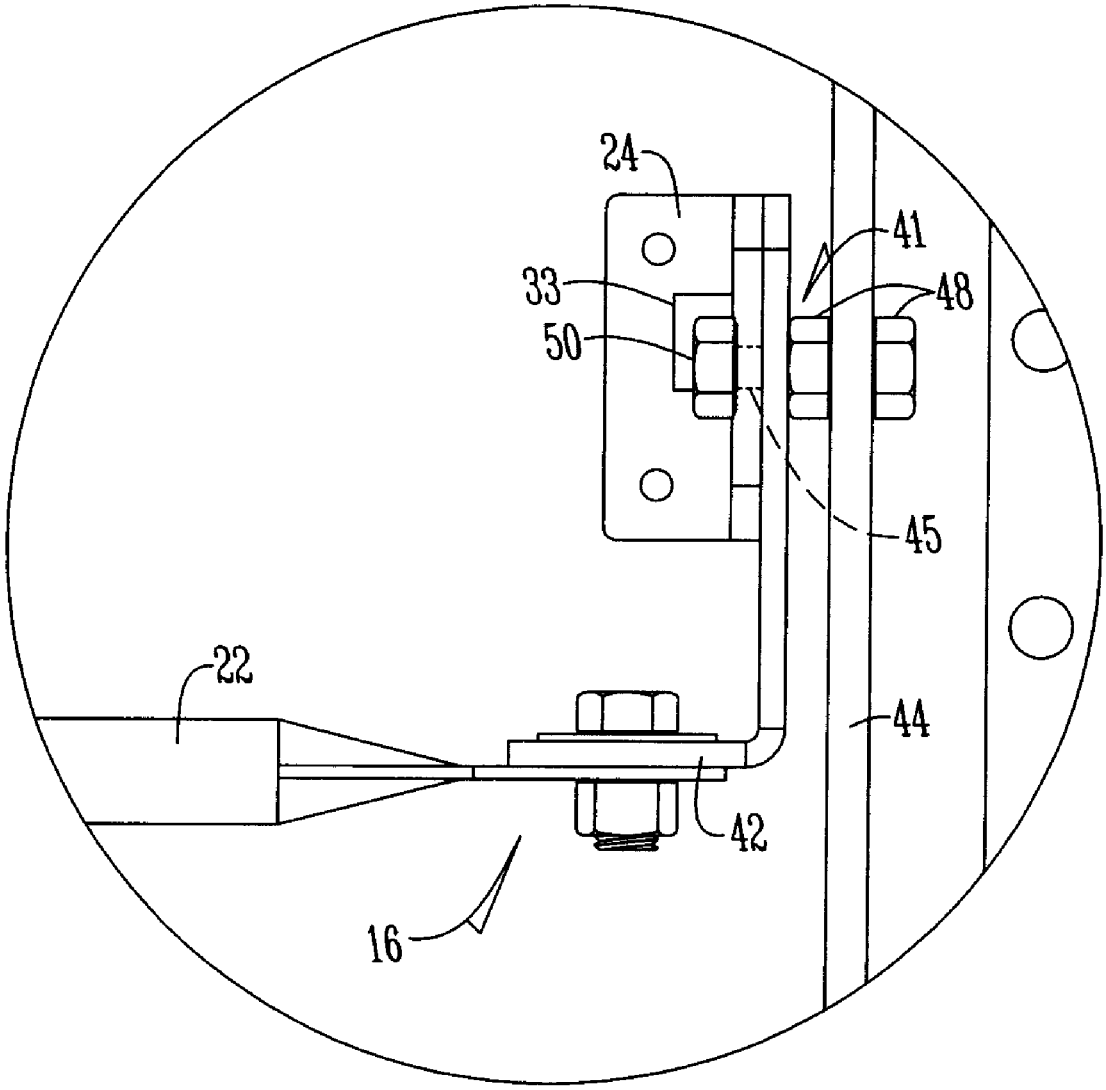
FIG. 4 is a side plan view of a latching apparatus.

As best shown in FIG. 2, as is conventional in the art, a plurality of integrating means 18 are secured to the bulk storage structure 10. The integrating means 18 are pin members, bolts, protuberance means or the like. Specifically the cover member 14 has a plurality of openings or bores that receive the integrating means 18.

The latch apparatus 16 includes a pair of latch members 20 having a latch bar 22 that is secured to and extends between the latch members 20. The latch apparatus 16 is pivotally mounted to the cover member 14 by brackets or eye bolts 24 that are attached to the cover member 14.

Figure 5A:
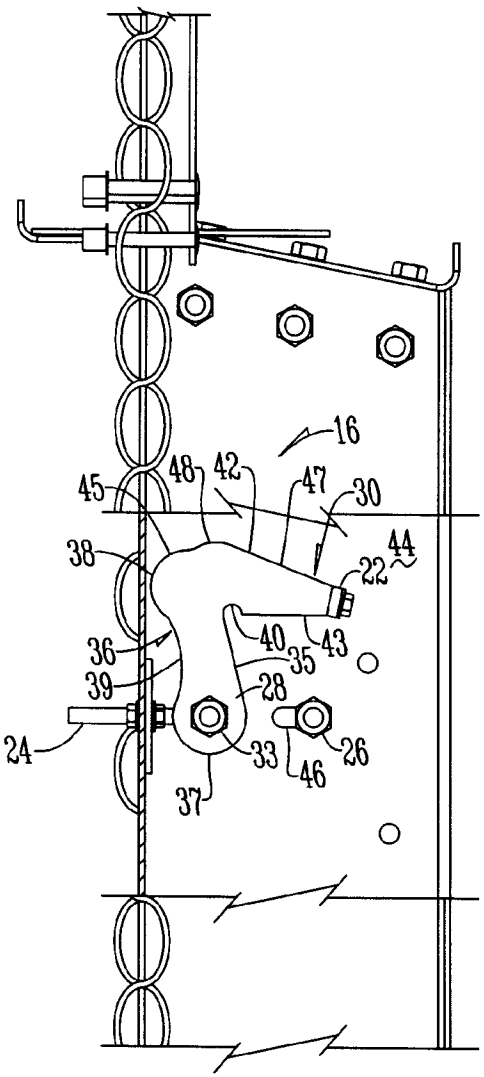
FIG. 5A is a side plan view of a latching apparatus in an unlocked position.
Figure 5:
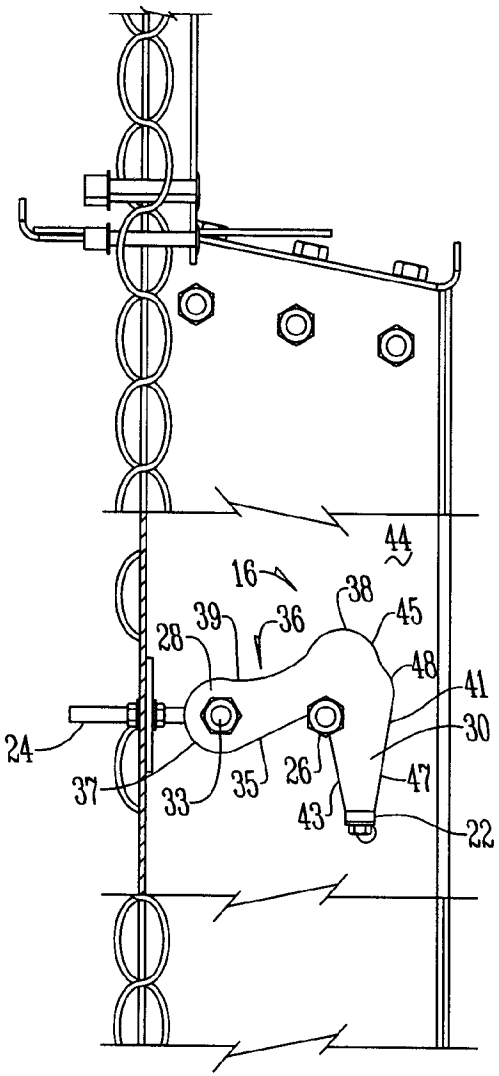
FIG. 5 is a side plan view of a latching apparatus in a locked position.
Figure 6:
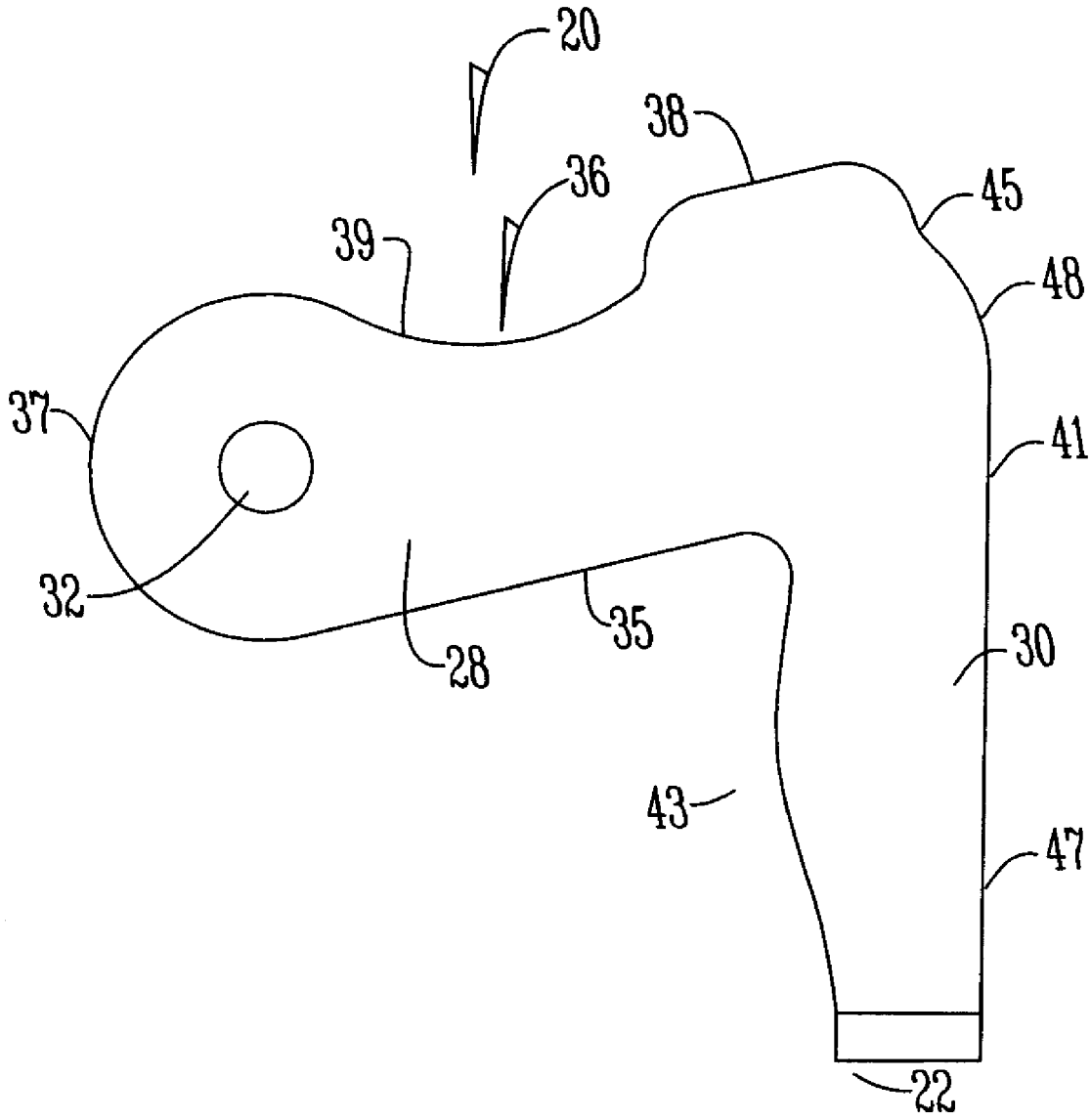
FIG. 6 is a side plan view of a latching apparatus.

The latch members 20 have a first section 28 and a second section 30 that are generally transverse or angled in relation to one another to generally form a J or an L-shape. The first section 28 has an opening or aperture 32 that receives a pivot pin 33 mounted to bracket or eye bolt 24. The first section 28 has an inner edge 35 and an outer edge 36 that extends from end 37 toward second section 30. Preferably, outer edge 36 has an outwardly extending portion 38 and an inwardly extending portion 39. The outwardly extending portion 38 is of any size or shape such as arcuate as shown in FIGS. 5 and 5A or hammerhead as shown in FIG. 6. The inner edge 35 of section 28 extends from end 37 to a receptacle 40 that is formed to receive a catch member 26. Preferably, inner edge 35 is angled inwardly in relation to the longitudinal axis of section 28 from end 37 to receptacle 40.

The second section 30 extends from the first section 28 and terminates in a flange 42 that is used to connect the latch bar 22 to the latch members 20. The second section 30 has an outer edge 41 and an inner edge 43. Preferably, the outer edge 41 has two portions 45 and 47 that generally extend outwardly in relation to the central axis of section 30 to a transition point 48 from portion 38 and flange 42 as shown by example in FIGS. 5 and 5A. Likewise, preferably, inner edge 43 extends outwardly in relation to the central longitudinal axis of section 30 from flange 42 toward receptacle 40. Alternatively, inner edge 43 is partially arcuate as shown in FIG. 6.

The catch member 26 is mounted to a door jamb 44. The catch member 26 is of any size, shape, and structure that is received within receptacle 40. Preferably, the catch member is comprised of a bolt 41 having a head 50 and a shaft 45. The shaft 45 of the bolt 41 extends through a pair of flange nuts 48 and slot 46 in door jamb 44. The flange nuts 48 have a plurality of serrations on their bottom surface that engage the door jamb 44. The shaft 45 of the bolt 41 is received within receptacle 40 between the head 43 of the bolt 41 and a flange nut 48. In one embodiment, the catch member 26 is mounted to the door jamb 44 through an elongated slot 46 so that the position of the catch member 26 may be adjusted within the length of the slot 46 to align with receptacle 40. Alternatively, the eye bolt 24 attached to the cover member 14 is adjusted so that the receptacle 40 aligns with the catch member 26.

To close the cover member 14 the latch bar 22, which is in an upward or raised position, is pulled toward the user such that the cover member moves toward a closed position and the latch members 20 are positioned above the catch member 26. Once in this position, the latch bar 22 is lowered such that the catch member 26 engages the second portion 30 of the latch member 20 and is guided toward and received within receptacle 40. The inner edge 43 of section 30 assists in guiding the catch member 26 toward receptacle 40. The downward motion of the latch bar 22 combined with the engagement with second section 30 provides a mechanical advantage that assists in pulling the cover member to a closed position that is locked once the catch member 26 is received within receptacle 40 as shown in FIG. 5.

To open the cover member 14, the latch bar 22 is raised until the portion 38 of first section 28 engages the cover member 14 which provides manual force to open the cover member 14. The rotation of the latch bar 22 permits greater acceleration resulting in greater manual force to open the cover member 14. The portion 38 permits adequate spacing between the cover member 14 and the latch bar 22, as well as prevents rotation of the latch bar 22 to a point where a user might injure their hands or their knuckles against the cover member 14.

Thus presented is a latching assembly 16 that both improves use and provides a safer bulk storage structure 10 than is currently known in the art. Consequently at the very least all of the stated objectives have been met.

It will be appreciated by those skilled in the art that other various modifications could be made to the device without the parting from the spirit and scope of this invention. All such modifications and changes fall within the scope of the claims and are intended to be covered thereby.

What is claimed is:

1. A latching apparatus comprising:

a latch assembly pivotally connected to a cover member and having a pair of latch members with a latch bar connected to and extending between the latch members;

wherein the latch members have a first section and a second section that are generally transverse to one another and the first section has an outer edge extending from an end of the first section to the second section;

wherein the outer edge of the first section includes a first portion which extends inwardly from a longitudinal axis of the first section and a second portion having a continuous, un-interrupted contour which extends outwardly from the longitudinal axis of the first section; and wherein the second section has an inner edge which extends outwardly from a central axis of the second section and angled toward the first section from the latch bar to a receptacle formed to receive a catch member.

2. The apparatus of claim 1 wherein the receptacle is on an inner edge of the first section.

3. The apparatus of claim 2 wherein the catch member is mounted to a door jamb and positioned to be received within the receptacle.

4. The apparatus of claim 3 wherein the catch member is mounted to the door jamb through an elongated slot.

5. The apparatus of claim 1 wherein the latch assembly is pivotably connected to the cover member by an adjustable eye bolt.

6. A latching apparatus, comprising:

a latch assembly pivotally connected to a cover member and having a pair of latch members with a latch bar connected to and extending between the latch members;

wherein the latch members have a first section and a second section that are generally transverse to one another and the first section has an outer edge extending from an end of the first section to the second section; and wherein the outer edge of the first section has a hammerhead shaped portion, wherein the hammerhead shaped portion has a continuous, un-interrupted contour that extends outwardly from the outer edge and a longitudinal axis of the first section.

7. The apparatus of claim 3 wherein the inner edge of the first section extends from the end of the first section to the receptacle.

8. The apparatus of claim 7 wherein the inner edge of the first section is angled inwardly in relation to the longitudinal axis of the first section from the end of the first section to the receptacle.

9. The apparatus of claim 3 wherein the inner edge of the second section guides the catch member toward the receptacle as the latching apparatus is lowered.

10. The apparatus of claim 9 wherein an outer edge of the second section has two portions that extend outwardly in relation to the longitudinal axis of the second section to a transition point.

11. The apparatus of claim 10 wherein the second section extends from the first section and terminates in a flange.

12. The apparatus of claim 11 wherein the inner edge of the second section extends from the flange to the receptacle.

13. The apparatus of claim 12 wherein one of the two portions extends from the flange to the transition point and the other of the two portions extends from the outer edge of the first section to the transition point.

14. The latching apparatus of claim 6 wherein the second section has an inner edge which extends outwardly in relation to a central longitudinal axis of the second section toward a receptacle such that the inner edge guides a catch member toward the receptacle as the latching apparatus is lowered.

* * * * *